US005231815A

United States Patent [19]

Colen

[11] Patent Number: 5,231,815

[45] Date of Patent: Aug. 3, 1993

[54] WALL CONSTRUCTION AND SPACER FOR USE THEREWITH

[76] Inventor: William J. Colen, 11248 Jamestown, Dallas, Tex. 75230

[21] Appl. No.: 969,083

[22] Filed: Oct. 30, 1992

Related U.S. Application Data

[63] Continuation-in-part of Ser. No. 775,285, Oct. 11, 1991, Pat. No. 5,159,795, which is a continuation-in-part of Ser. No. 553,176, Jul. 13, 1990, Pat. No. 5,056,289.

[51] Int. Cl.[5] ..... E04B 1/02

[52] U.S. Cl. ..... 52/438; 52/56; 52/712; 52/71; 52/744

[58] Field of Search ..... 52/321, 428, 562, 564, 52/712–715, 584, 438–442, 421, 744

[56] References Cited

U.S. PATENT DOCUMENTS

| | | | |
|---|---|---|---|
| 581,940 | 5/1897 | Pelton | 52/509 |
| 783,470 | 2/1905 | Schreck | 52/714 |
| 840,111 | 1/1907 | Collins | 182/228 |
| 855,048 | 5/1907 | Curlett | 52/584 |
| 901,833 | 10/1908 | Rettig | 52/421 |
| 949,527 | 2/1910 | Ensminger et al. | 52/421 |
| 963,776 | 7/1910 | Kosack | 52/715 |
| 963,778 | 7/1910 | Kosack | 52/713 |
| 1,052,670 | 2/1913 | Francis | 52/714 |
| 1,146,223 | 7/1915 | Wiswell | 52/715 |
| 1,451,144 | 4/1923 | Decker | 52/437 |
| 1,503,931 | 8/1924 | Wightman | 52/421 |
| 1,558,247 | 10/1925 | Decker | 52/435 |
| 1,610,398 | 12/1926 | Tinker | 52/124.2 |
| 1,639,594 | 8/1927 | Decker | 52/428 |
| 1,968,393 | 7/1934 | Henderson | 52/41 |
| 1,982,560 | 11/1934 | Williams | 52/387 |
| 1,997,092 | 4/1935 | Duffy | 52/488 |
| 2,043,706 | 9/1936 | Myers | 52/387 |
| 2,172,816 | 9/1939 | Douglas et al. | 52/438 |
| 3,170,267 | 2/1965 | Rosenfeld | 52/438 |
| 3,696,576 | 10/1972 | de Barros | 52/747 |
| 4,062,159 | 12/1977 | Pahr | 52/421 |
| 4,696,140 | 9/1987 | Marshall | 52/482 |
| 4,774,793 | 10/1988 | Mayer | 52/308 |
| 5,056,289 | 10/1991 | Colen | 52/564 |
| 5,159,795 | 11/1992 | Colen | 52/564 |

*Primary Examiner*—James L. Ridgill, Jr.
*Attorney, Agent, or Firm*—David H. Judson

[57] ABSTRACT

The present invention describes a unique wall construction and spacer for use by unskilled labor in such construction. The wall comprises a plurality of blocks arranged in layers one above the other, each of the blocks having first and second sides, an exterior face, an interior face, a top and a bottom, and at least one cutout extending through the block between the top and bottom. The tops of adjacent blocks in each layer are adapted to be located in a common plane and each block is adapted to be separated from an adjacent block in the layer by a predetermined distance. The spacer comprises a base including a medial portion, first and second opposed ends and a pair of opposed edges, at least one spacing tab attached to the medial portion of the base along an opposed edge thereof and extended at a downward angle from the base, and first and second V-shaped supports located at and extending transversely from the first and second opposed ends of the base, respectively, each of the supports having a medial portion and first and second opposed legs. Each leg has a distal end, and upper and lower tabs located along a portion of the leg. The spacer is designed to be completely encased within the wall when the mortar joints are filled.

5 Claims, 5 Drawing Sheets

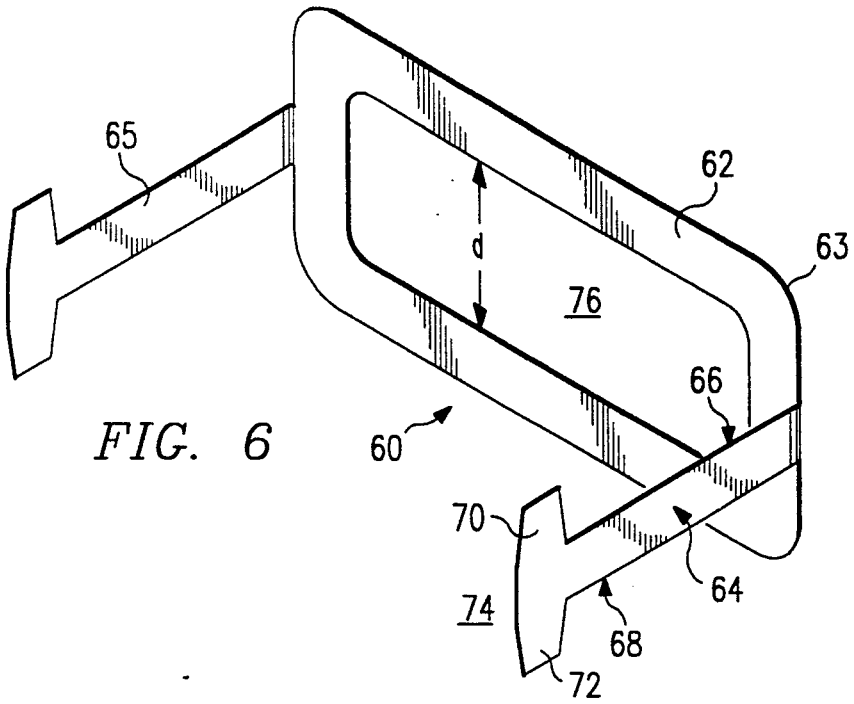
FIG. 6
FIG. 6A
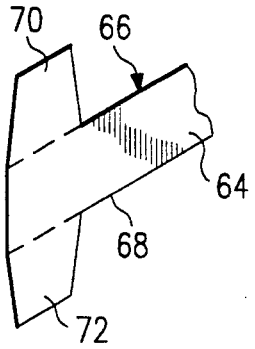
FIG. 6B
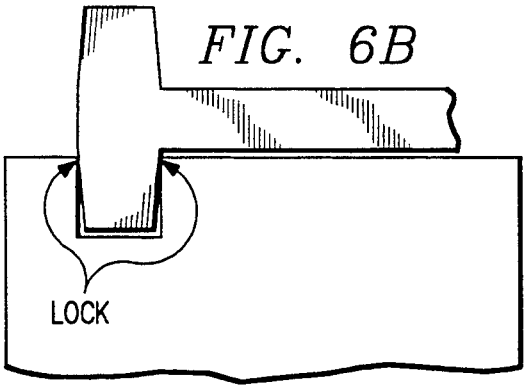
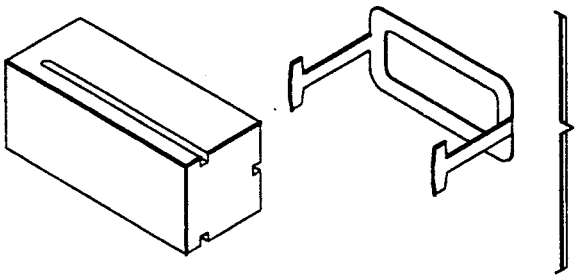
FIG. 7

WALL CONSTRUCTION AND SPACER FOR USE THEREWITH

This application is a continuation-in-part of prior copending application Ser. No. 07/775,285, filed Oct. 11, 1991, now U.S. Pat. No. 5,159,795, which application was a continuation-in-part of Ser. No. 07/553,176, filed Jul. 13, 1990, now U.S. Pat. No. 5,056,289.

TECHNICAL FIELD

The present invention relates generally to construction of cinder, clay or concrete block walls and more particularly to a novel spacer for use in such construction to facilitate correct alignment of the blocks even by unskilled laborers.

BACKGROUND OF THE INVENTION

Masonry construction techniques are well-known in the art. Such techniques, however, are impractical for many building projects due to the high cost of labor and materials. Additionally, because mortar must be applied by hand to each brick and the brick must be properly aligned with the bricks already in place, a high degree of skill is required to provide an aesthetically-pleasing result. Such results are extremely difficult to achieve with unskilled labor.

There have been attempts in the prior art to provide systems for assisting a laborer to properly aligning the bricks of a wall construction. Such systems are described in U.S. Pat. Nos. 2,172,816 and 3,170,267 to Douglas et al and Rosenfeld, respectively. In Douglas et al, for example, a plurality of T-shaped dowel plates are supported in aligned grooves along at least three edges of each brick. Rosenfeld describes a system wherein rod-like members are provided for vertical alignment with cross bars between such members for horizontal alignment.

While such systems do provide improvements over manual techniques for aligning bricks in a wall construction, they do not adequately solve the problems associated with the use of unskilled labor. Moreover, the complexity of such systems make them difficult to use in practice and often more expensive than the cost of labor and materials. Such systems also do not reliably stabilize the bricks against lateral movement.

There is therefore a need to provide an improved wall construction technique that overcomes these and other problems associated with the prior art.

BRIEF SUMMARY OF THE INVENTION

It is an object of the present invention to provide a method for constructing a cinder or concrete block wall using unskilled labor.

It is yet another object of the present invention to describe a method for constructing a block wall that utilizes a plurality of inexpensive yet reliable alignment spacers.

It is a further object of the invention to provide a novel spacer construction for use by unskilled laborers in the construction of a block wall.

It is yet a further object of the present invention to describe a block wall construction comprising a plurality of blocks arranged in layers one above the other, and a plurality of simple-to-use spacers to aid in the construction of the wall.

It is a another object of the invention to provide a block wall construction technique that is simple to implement and results in significant labor cost savings over prior art techniques.

These and other objects of the invention are provided in a spacer for use in the wall construction for a building or the like. The wall generally comprises a plurality of blocks arranged in at least first and second layers spaced one above the other by a predetermined distance, each block having first and second sides, an exterior face, an interior face, a top and a bottom, and a pair of cutouts extending through the block between the top and bottom. The tops of adjacent blocks in each layer are adapted to be located in a common plane and each block is adapted to be separated from an adjacent block in the layer by a predetermined distance. According to the preferred embodiment, the spacer comprises: a base including a medial portion, first and second opposed ends and a pair of opposed edges, at least one spacing tab attached to the medial portion of the base along an opposed edge thereof and extended at a downward angle from the base, and first and second V-shaped supports located at and extending transversely from the first and second opposed ends of the base, respectively, each of the supports having first and second opposed legs, with each leg having a distal end, and upper and lower tabs located along a medial portion of the leg.

In use, the base is supported in the common plane overlying the first side of a first block in the first layer and a second side of a second block in the first layer. The spacing tab extends at a downward angle from the base into a space between the first and second blocks to create and maintain a mortar joint between the first and second blocks. The lower tabs of the first support extend into a first cutout of the first block and the upper tabs of the first support extend into a first cutout of a third block overlying the first and second blocks. Likewise, the lower tabs of the second support extend into a first cutout of the second block and the upper tabs of the second support extend into the second cutout of the third block. The distal ends of the legs create and maintain a mortar joint between the first and second layers when the block is supported on the spacer against the tops of the first and second blocks.

Thus according to the invention, when the spacer is used the distal ends of the legs do not extend beyond the interior and exterior faces of the blocks and therefore the spacer is not visible when the mortar joints are filled.

The foregoing has outlined some of the more pertinent objects of the present invention. These objects should be construed to be merely illustrative of some of the more prominent features and applications of the invention. Many other beneficial results can be attained by applying the disclosed invention in a different manner of modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which:

FIG. 6 is a perspective view of another type of spacer construction;

FIG. 6A is a detailed view of the tab structures of the spacer of FIG. 6A;

FIG. 6B is a detailed cross-sectional view of the positioning of the wedge-shaped tab in a square alignment groove;

FIG. 7 is a perspective view of block having longitudinal grooves for use in a wall construction in conjunction with the spacer of FIG. 6;

Similar reference characters refer to similar parts throughout the several views of the drawings.

DETAILED DESCRIPTION

Figure 1:
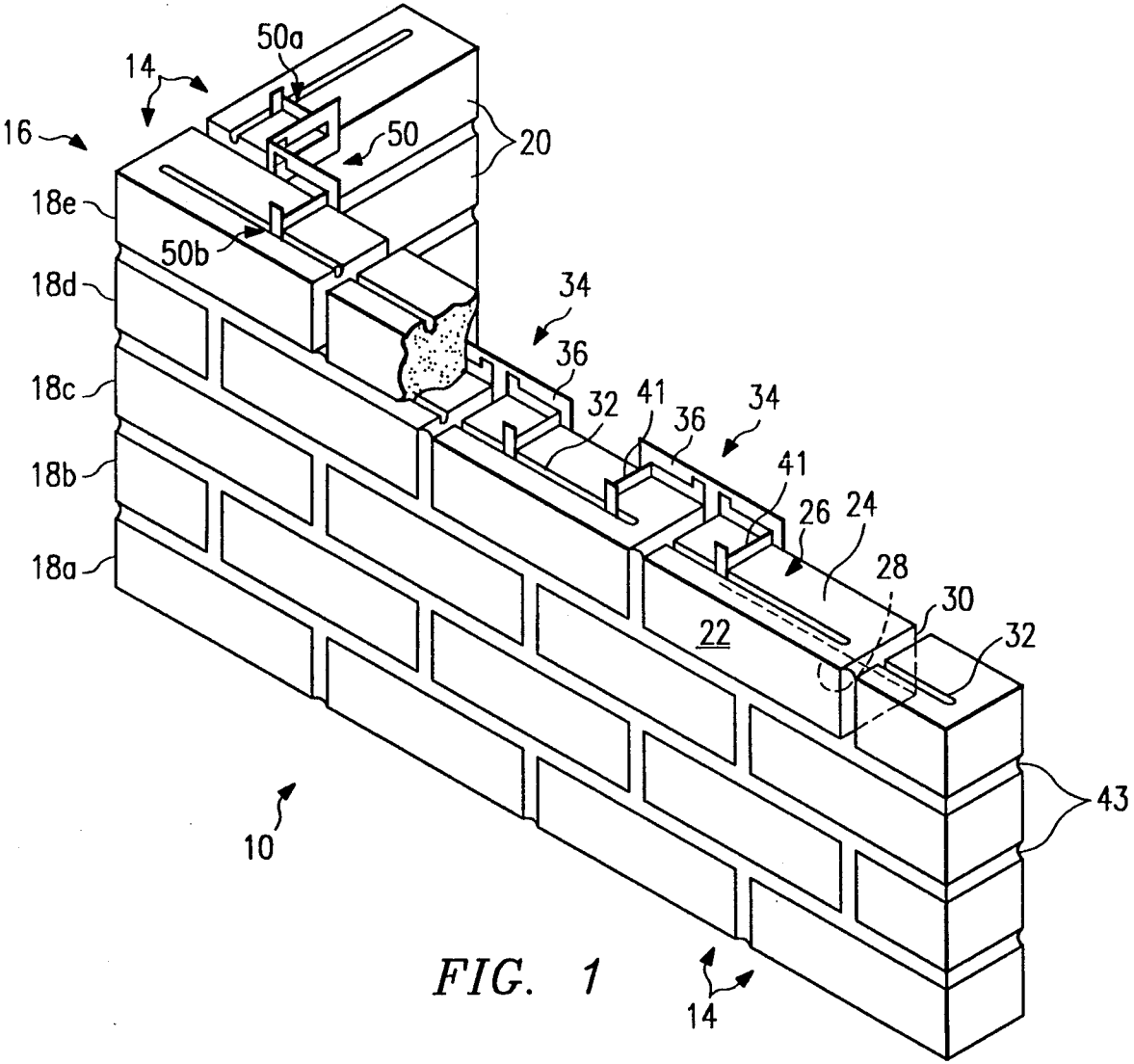
FIG. 1 is a perspective view of a brick wall construction wherein a plurality of spacers are used to facilitate alignment of the bricks by laborers.

Referring now to FIG. 1, a novel wall construction 10 is shown as described in U.S. Pat. No. 5,056,289 and includes a front portion 12 and a side portion 14 defining a corner 16. The wall comprises a plurality of blocks 20 arranged in layers 18*a*–18*e* one above the other, each of the blocks having an exterior face 22, an interior face 24, a top 26, a bottom 28 and sides 30. Each of the blocks is preferably a brick, although it should be appreciated that the teachings of U.S. Pat. No. 5,056,289 are applicable to any wall construction using blocks and not merely brick walls. The top 26 and bottom 28 of each block 20 preferably includes an alignment means such as a longitudinally-extending groove or notch 32. As seen in FIG. 1, the grooves 32 are aligned with the grooves of adjacent blocks. While the use of longitudinal grooves is preferred, it should also be appreciated that each brick can alternatively incorporate other types of alignment means. For example, conventional clay bricks typically are manufactured with one or more transverse holes throughout the mid-section of each brick. Such holes are useful as the alignment means as will be described in more detail below.

Figure 2:
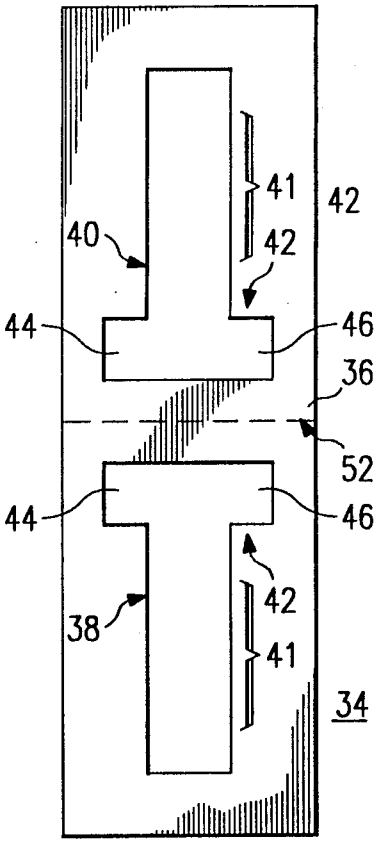
FIG. 2 is a top view of one of the spacers of FIG. 1 showing the flattened construction thereof prior to separation of the support arms from the base thereof.
Figure 3:
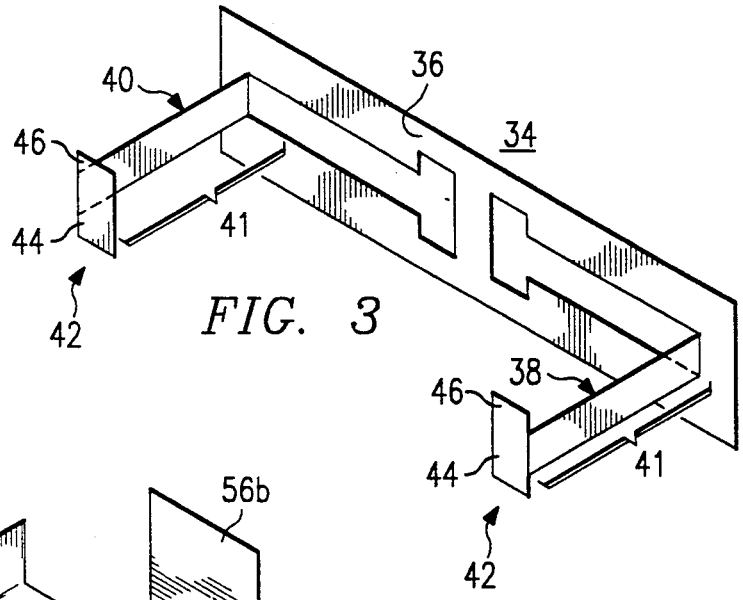
FIG. 3 is a perspective view of the spacer of FIG. 2 with the support arms extended away from the base.

According to the teachings of U.S. Pat. No. 5,056,289, a plurality of spacers 34 are arranged between adjacent blocks for the purpose of facilitating the proper alignment of the blocks during construction of the wall. Referring simultaneously to FIGS. 2 and 3, each of the spacers is preferably formed in a flat profile and includes a base 36 having first and second support arms 38 and 40 integrally-formed therein. The support arms 38 and 40 are adapted to be cut-out from the remainder of the base 36 in the manner shown in FIG. 3 to enable the spacer to be used in the wall construction. Each support arm preferably includes at its distal end a tab 42 having first and second portions 44 and 46.

In operation, each of the support arms 38 and 40 is extended substantially transversely from the base and the tab 42 is then itself turned substantially transversely with respect to the arm such that the tab is substantially parallel to the base. This structure can be effected by the manufacturer or, alternatively, by the laborer at the jobsite. The resulting spacer construction is best seen in FIG. 3. Alternatively, the spacer can be formed with or without cut-out portions using arms secured to the base by welding, hinges, fasteners or the like. The major portion 41 of each arm has a predetermined height equal to the desired height (approximately ⅜ths of an inch) of the mortar joint 43 between successive layers 18 of the brick wall.

Referring now back to FIG. 1, the major portions 41 of the first and second arms are supported against the tops 26 of adjacent blocks, and the base 36 is advantageously supported against the interior faces 24 of the adjacent blocks. This spacer structure and placement provides horizontal, vertical and lateral stabilization of each brick as the brick is placed in its proper position on the wall. In particular, the first portion 44 extends downwardly into the groove of a block underlying the arm and the second portion 46 extends upwardly into the groove of the block overlying the arm.

The spacer of FIG. 3 is preferably formed of steel, aluminum or other metals. Suitable other materials include impact resistant cardboard, composites or rigid plastics. As described in U.S. Pat. No. 5,056,289, the spacer has significant advantages over the prior art. It is simple and inexpensive to manufacture and provides a reliable tool for assisting even unskilled laborers to construct a brick wall. The spacer is designed to remain in the wall upon use. Each spacer is formed in a flat profile and the spacers can be easily transported to the jobsite and stored for subsequent use. Moreover, the use of the cut-out support arms as described above is especially advantageous because the voids left by the cut-outs facilitate the removal of excess mortar in the mortar joint 43 when the overlying brick is placed on the spacer. Without these voids, excess mortar would be forced forwards toward the exterior face and would be difficult to remove properly without extensive effort by the laborer.

As also seen in FIG. 1, a corner spacer 50 is provided by manufacturing the spacer with a transverse line of weakness 52 as shown in FIG. 2 in phantom. This line of weakness enables the spacer to be bent into first and second transverse sections 50*a* and 50*b*.

Although not shown in detail in FIGS. 2 and 3, it should be appreciated that the structure of the tab 42 can be suitably changed to cooperate with the various types of alignment means in the top and bottom of each brick. As discussed above, for example, if clay bricks are used for the blocks, each tab has a semi-circular structure to mate with the transverse holes extending through the brick. Of course, the exact placement of the longitudinal groove or other alignment means in each brick is not critical although preferably such grooves are located adjacent the exterior face of the brick such that the weight of the overlying brick is distributed along a relatively long support arm.

Figure 4:
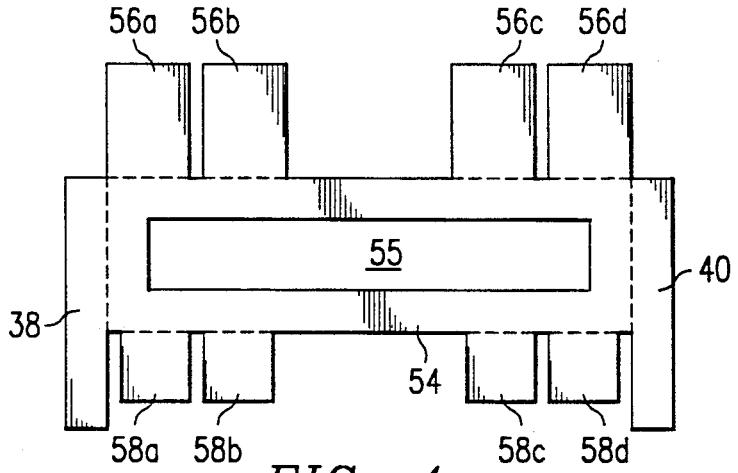
FIG. 4 is a top view of an alternate embodiment of the spacer in its flattened form.
Figure 5:
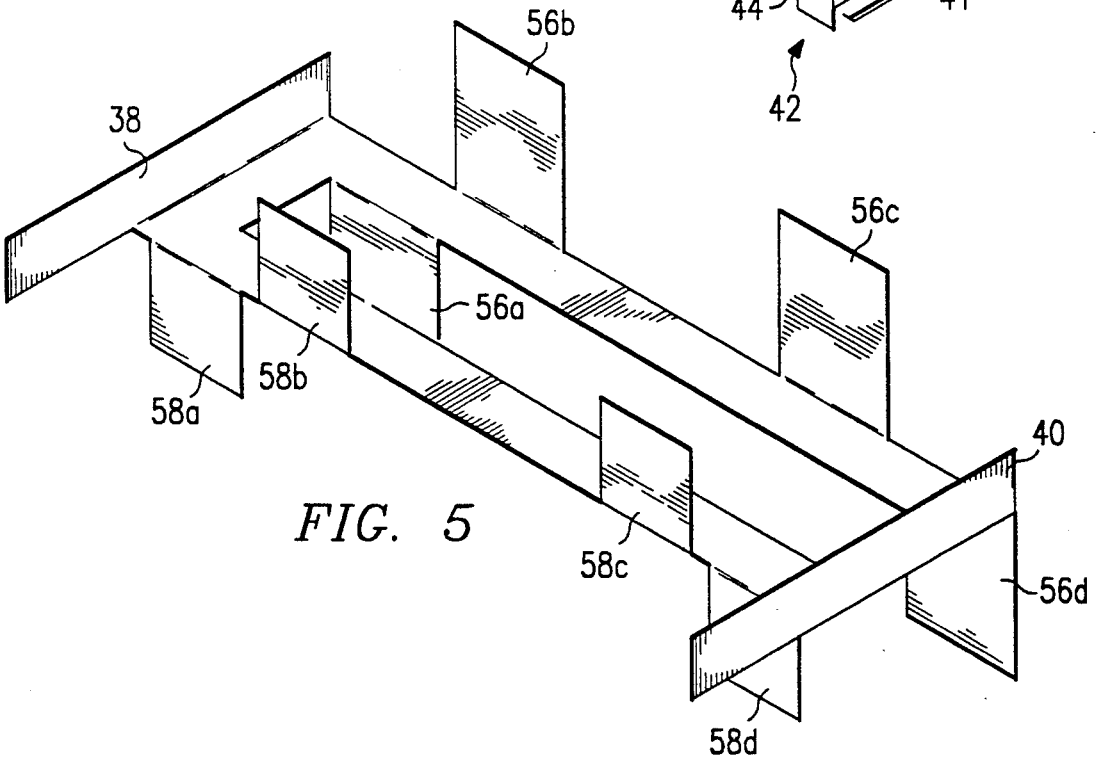
FIG. 5 is a perspective view of the spacer of FIG. 4 adapted for use in the wall construction.

FIGS. 4 and 5 show an alternate embodiment of the spacer. Spacer 52 comprises a base 54 having a cut out portion 55. A plurality of tabs 56*a*–56*d* extend from one side of the spacer and a plurality of tabs 58*a*–58*d* extend from the opposite side. First and second support arms 38 and 40 extend from the sides of the spacer. Upon folding of the tabs 56 and 58 as shown in FIG. 5, the spacer is useful in aligning bricks as described above. In particular, tabs 56 are supported against the interior faces 24 of adjacent bricks and correspond to the base of the spacer described above in FIG. 2. Tabs 58 are then supported in the longitudinal grooves of the bricks.

Referring now to FIGS. 6 and 6A, an alternate spacer construction is shown for use in the construction of a wall comprising a plurality of blocks arranged in at least first and second layers spaced one above the other by a predetermined distance. This construction is described in U.S. Pat. No. 5,159,795. As previously described with respect to FIG. 1, each of the blocks has an exterior face, an interior face, a top and a bottom, with the top and bottom of each block having alignment means located a predetermined distance from the interior face and adapted to be aligned with the alignment means of adjacent blocks, with the tops of adjacent blocks in each layer located in a common plane. Preferably the spacer 60 is used with blocks having a square-shaped or wedge-shaped alignment means. A block with a square-shaped alignment groove is shown, for example, in FIG. 7. The spacer 60 includes a base 62 for support against the interior faces of adjacent blocks. The base preferably includes rounded corners 63 for ease and safety of handling by the user. A first support arm 64 extends transversely from the base 62 in a plane perpendicular to the common plane, the arm 64 having an upper edge 66 for supporting a bottom of a block in the second layer and a lower edge 68 for supporting a top of the block in the first layer. In this way, a mortar joint is created between the first and second layers of the wall.

The spacer 60 further includes upper and lower wedge-shaped tabs 70 and 72 located at a distal end 74 of the support arm 64 for being received in the longitudinal grooves of the blocks overlying and underlying the support arm. As best seen in FIG. 6A, the tabs 70 and 72 are located in the same plane as the plane of the support arm. When the alignment groove is square, the tabs "lock" therein when the spacer is positively positioned, as best seen in FIG. 6B. Of course, the tabs 70 and 72 can be made to fit precisely into the groove, whether the groove is square, wedge-shaped or any other shape.

Referring back to FIG. 6, the base 62 includes the cut-out portion 76 which, when the spacer is placed, is located adjacent to the mortar joint such that excess mortar can be removed through the cut-out portion 76 during the wall construction. The cut-out portion preferably has an cross-sectional dimension "d" greater than the predetermined distance between the first and second layers of the wall. This larger area of the cut-out portion facilitates the prompt and efficient removal of excess mortar.

Figure 8:
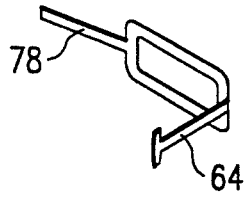
FIG. 8 is a perspective view of another type of spacer for use in the corner of a wall construction.
Figure 9:
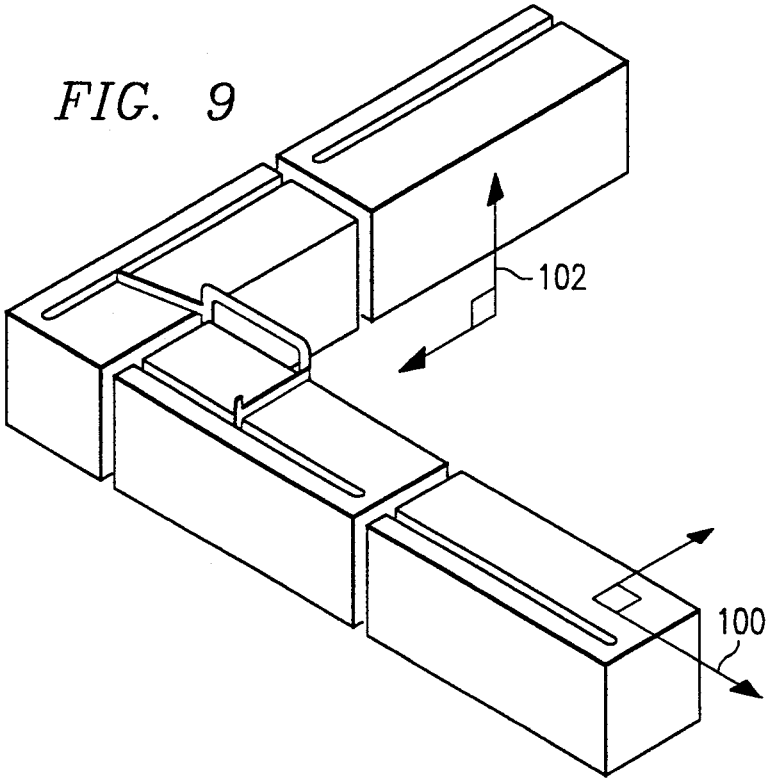
FIG. 9 is a perspective view showing how the spacer of FIG. 8 is used to facilitate the corner wall construction.

Referring now to FIG. 8, as shown in U.S. Pat. No. 5,159,795, the spacer may alternatively include a second support arm 78 extending from the base 62 at an oblique angle to enable the spacer to be used in a corner of the wall. The oblique angle is approximately 135 degrees. The placement of the spacer is shown in FIG. 9, which is a perspective view of a corner wall construction. Of course, it should be appreciated that the spacer of FIG. 8 can be formed from the spacer of FIG. 6 at the jobsite by merely cutting the distal end of the second support arm (i.e., the portion of the second support arm having the upper and lower tabs) and then bending the second support arm to the desired oblique angle.

Figure 10:
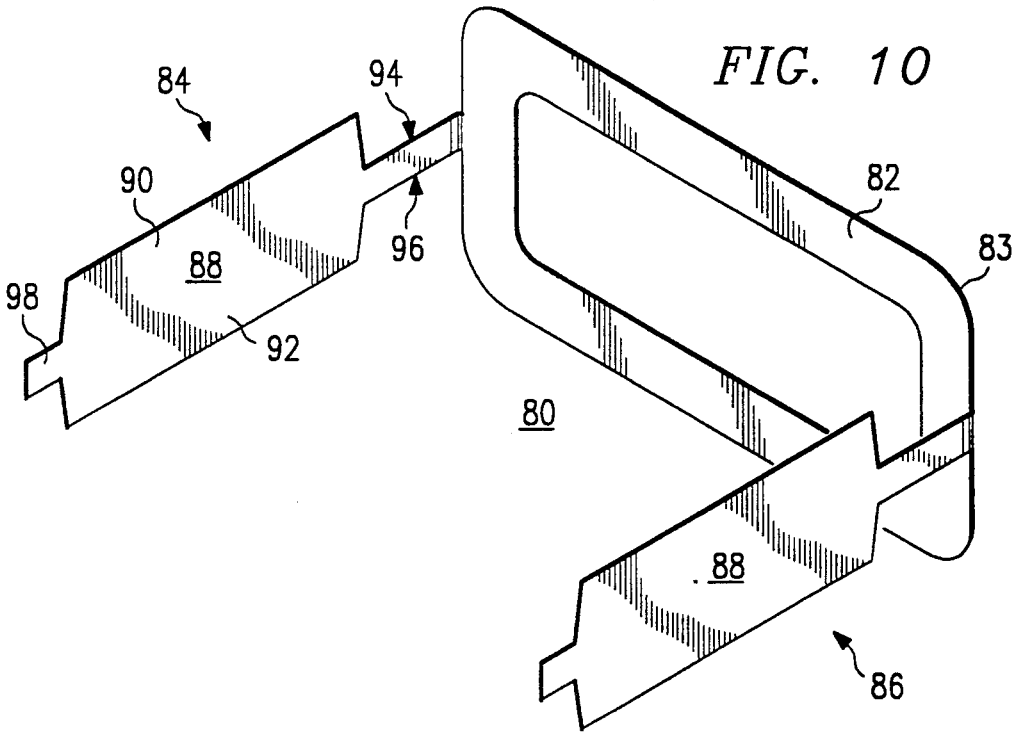
FIG. 10 is a perspective view of yet another type of spacer for use in a wall construction comprising blocks.

FIG. 10 shows yet another alternate embodiment of the spacer 80 of U.S. Pat. No. 5,159,795 for use in the construction of a wall comprising a plurality of blocks arranged in at least first and second layers spaced one above the other by a predetermined distance. As previously described with respect to FIG. 1, each of the blocks has an exterior face, an interior face, a top and a bottom, with the top and bottom of each block having alignment means located a predetermined distance from the interior face and adapted to be aligned with the alignment means of adjacent blocks, with the tops of adjacent blocks in each layer located in a common plane. Preferably the spacer 80 is used with blocks having alignment means in the form of one or more relatively large openings. These openings are Preferably circular but can be of any appropriate shape.

In the embodiment of FIG. 10, the spacer comprises a base 82 for support against the interior faces of adjacent blocks. The base preferably includes rounded corners 83 for ease and safety of handling by the user. A first support arm 84 extends transversely from the base 82 in a plane perpendicular to the common plane. The spacer 80 also may include a second support arm 86 that extends transversely from the base 82. One or both of the support arms include an medial portion 88. Each medial portion 88 includes upper and lower wedge-shaped tabs 90 and 92 for being received in the alignment openings of the blocks overlying and underlying the support arm. Each of the support arms has an edge 94 for supporting a bottom of a block in the second layer and a edge 96 for supporting a top of the block in the first layer. In this way, a mortar joint of a predetermined distance is created between the first and second layers of the wall. The spacer 80 may also include a tab 98 at the distal end of each support arm.

Figure 11:
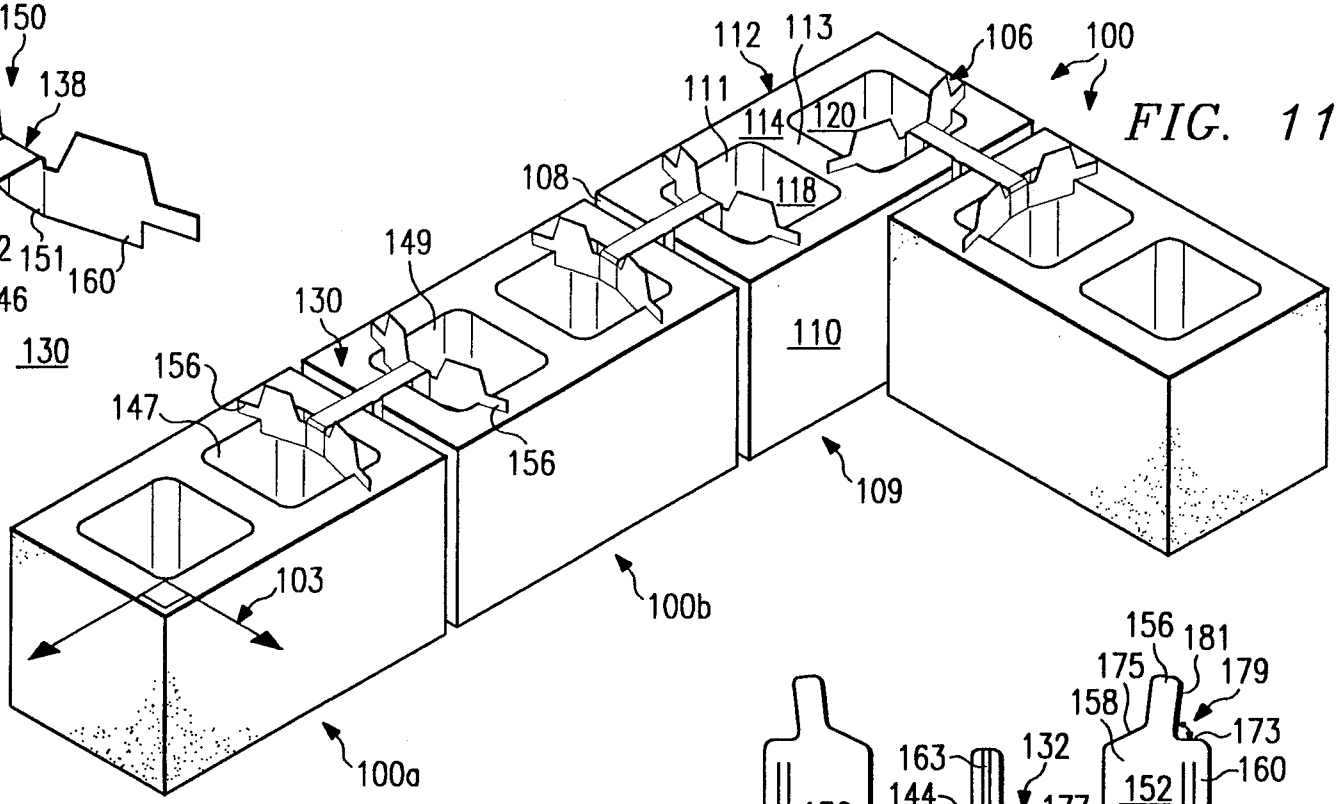
FIG. 11 is a perspective view of still another type of wall construction comprising cinder blocks.

With the above as background, the present invention can now be described. This invention relates generally to building wall constructions formed of cinder, concrete or clay blocks, although it should be appreciated that the novel spacer is useful for any type of block or brick. For illustrative purposes, the invention is shown in the context of a cinder block wall. Such wall constructions are well-known and as shown in FIG. 11 generally comprise a plurality of blocks 100 arranged in at least first and second layers 102 and 104 spaced one above the other by a mortar joint having a predetermined distance. Typical, a cinder block is approximately 8" by 8" by 16" (or 8" by 12" by 16") in size and has first and second sides 106 and 108, a front 109 having an outer face 110, a back 111 having an outer face 112, a top face 114, a bottom face 116, a cross member 113 located between the front 109 and the back 111, and a pair of openings or "cutouts" 118 and 120 extending through the block between the top and bottom faces. Each of the cutouts typically is tapered slightly from top to bottom as a result of the casting or other forming process used to make the blocks. Of course, the block may include only a single cutout or opening, and the cutout need not extend all the way through the block. In the construction of a wall, the tops of adjacent blocks in each layer or course of the wall are adapted to be located in a common plane 103 and each block is adapted to be separated from an adjacent block in the layer by a mortar joint having a predetermined distance. Such spacing is accomplished through use of a novel spacer according to the present invention.

Figure 12:
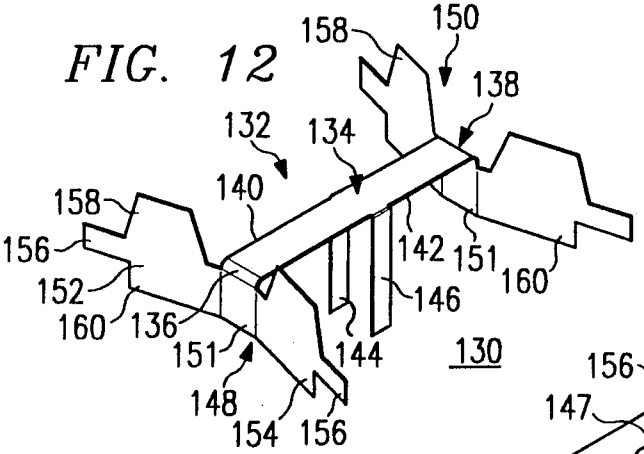
FIG. 12 is plan view of the preferred spacer for use in the wall construction of FIG. 11.

According to the preferred embodiment as shown in FIG. 12, the spacer 130 comprises: a base 132 including a medial portion 134, first and second opposed ends 136 and 138 and a pair of opposed edges 140 and 142. The spacer includes first and second spacing tabs 144 and 146 attached to the medial portion 134 of the base 132 along opposed edges 140 and 142. These spacing tabs extend at a downward angle (between 20 and 90 degrees) from the base 132. The spacing tabs may be either attached to or integrally formed with the base. The spacer 130 also includes first and second supports 148 and 150 located at and extending transversely from the first and second opposed ends 136 and 138 of the base, respectively. The supports may be either attached to or integrally formed with the base, and each support has a substantially V-shape when the spacer is viewed in plan (in use). In particular, each of the supports has a medial portion 151 attached to formed with an end of the base, and first and second opposed legs 152 and 154. Each leg has a distal end 156. Each support further preferably includes upper and lower tabs 158 and 160 located along a medial portion of the leg. The upper tabs 158 are designed to "rise" up into a cutout portion of an overlying block as will be described.

In use (as best seen in FIGS. 11–12), the medial portion 151 of each support is bent at an approximately 100 degree angle with respect to the base. The legs of each support are then angled outward (approximately 25 degrees) with respect to the medial portion 151 to form a somewhat flattened V-shape. The base 132 of the spacer is then supported in (or just parallel above) the common plane 103 overlying the first side 106 of a first block 100*a* in the first layer and a second side 108 of a second block 100*b* in the first layer. The spacing tabs 144 and 146 extend at a downward angle from the base into a space between the first and second blocks to create and maintain a mortar joint between the first and second blocks. The tabs also advantageously align the blocks longitudinally. The lower tabs 160 of the first support 148 extend into a first cutout 147 of the first block and the upper tabs 158 of the first support 148 extend into a first cutout of a third block (not shown) overlying the first and second blocks. Likewise, the lower tabs 160 of the second support 150 extend into a first cutout 149 of the second block and the upper tabs 158 of the second support 150 extend into the second cutout of the third block. When the spacer is placed in the blocks, the legs of each support spring outward approximately 5 more degrees (or approximately 30 degrees total with respect to the medial portion 151) to retain the spacer. As should be appreciated, the distal ends 156 of the legs create and maintain a mortar joint between the first and second layers when the block is supported on the spacer against the tops of the first and second blocks.

According to the invention, when the spacer is used, the distal ends 156 of the legs do not extend beyond the outer faces of the blocks and therefore the spacer is not visible when the mortar joints are filled. Further, although not shown in detail, it should be appreciated that cement material is used to fill the mortar joints before or after the placement of the spacer on the wall. Of course, the spacer is placed prior to hardening of the cement material. Use of the spacers in the manner disclosed herein significantly reduces mortar requirements and helps to maintain the structural stability of the wall while the cement hardens.

The spacer construction of FIG. 11 is advantageous because the first and second substantially V-shaped supports function like leaf springs to help retain the structure rigid. When cinder blocks are used to create the wall, the spacer is formed from a piece of flattened 20 gauge steel or the like. For example, and with reference to FIG. 13, the spacer may be formed from a sheet of steel and includes the various component parts described above. If desired, the spacer 130 may include stiffening ribs 161, 163 and 165 along the length of the base, along the spacing tabs and along the supports, respectively, to enhance the structural integrity of the spacer. Appropriate crimp or fold lines 167 and 169 may be used to facilitate the bending of the spacing tabs and the supports at the job site. Typically, however, the spacer can be delivered to the site with the tabs and supports pre-bent.

Figure 13:
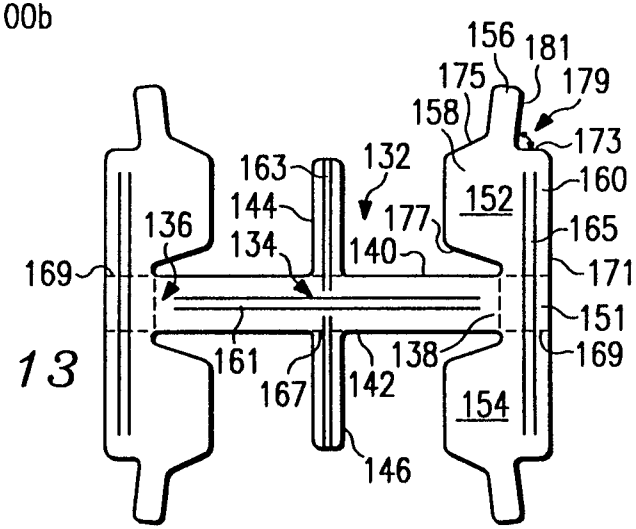
FIG. 13 is a plan view of the spacer of FIG. 12 formed in a flattened sheet.

Preferably, the material used to form the spacer is not so rigid as to prevent the worker from conforming the supports to the precise geometry of the block. Thus some supports may need to be bent more than others, or some legs may be at slightly different angles than other legs depending on the physical characteristics of the block cutouts or other surfaces. As seen in FIG. 13, the outermost or bottom edge 171 of each support is preferably flat, and the lower tabs 160 each are defined by the bottom edge 171 and an outer edge 173 preferably transverse thereto. The riser tabs are wedge-shaped by virtue of the angled surfaces 175 and 177. Preferably, the distal end of each leg is slightly angled with respect to the outer edge 173. This angle, represented by reference numeral 179, is preferably 5 degrees when the support leg is angled outward approximately 25 degrees relative to a medial portion 151 and the medial portion is angled approximately 100 degrees relative to the base. This construction insures linear (as opposed to point) contact of the distal arm such that the bottom edge 181 thereof rests firmly on the top of the block Although not shown, the spacers may be stacked in a nested manner for ease of transport because the angle between the medial portion and the base is greater than 90 degrees.

It should be appreciated by those skilled in the art that the specific embodiments disclosed above may be readily utilized as a basis for modifying or designing other structures for carrying out the same purposes of the present invention. For example, the spacer 130 may include first and second supports 148 and 150 located at and extending transversely from the first and second opposed ends 136 and 138 of the base, respectively, however, first support may include just one leg 152 while the second support includes a diagonally opposed leg 154. Also, in some cases it may desirable to omit one or more of the riser tabs that are received in the cutout portions of the overlying blocks, although generally such tabs will be used.

Further modifications include the use of legs that are not angled relative to the medial portion, or even legs that are angled in an opposed manner (i.e., at an angle of −25 degrees relative to the plane of the medial portion 151). In the latter case, of course, the base must have a longer length. The legs may also be located in the same plane as the base 132 (i.e., not retained in the cutouts), in which case the distal ends must be bent transversely to form the mortar joint between layers. Although not shown, it is also desirable to use the spacers to form columns, in which case the spacers are rested over the cross member of each block. Also, relative to the base, the supports and/or the spacing tabs may be oriented upside down from the orientation shown in FIG. 12. It should also be realized by those skilled in the art that such equivalent constructions do not depart from the spirit and scope of the invention as set forth in the appended claims.

What is claimed is:

1. A spacer in the construction of a wall comprising a plurality of blocks arranged in at least first and second layers spaced one above the other by a predetermined distance, each block having first and second sides, a front having an outer face, a back having an outer face, a top and a bottom, and at least one cutout extending through the block between the top and bottom, wherein the tops of adjacent blocks in each layer are adapted to be located in a common plane and each block is adapted to be separated from an adjacent block in the layer by a predetermined distance, comprising:

a base supported in the common plane overlying the first side of a first block in the first layer and a second side of a second block in the first layer, the base including a medial portion, first and second opposed ends and a pair of opposed edges;

at least one spacing tab attached to the medial portion of the base along an opposed edge thereof and extended at a downward angle from the base into a space between the first and second blocks to create and maintain a mortar joint between the first and second blocks;

first and second V-shaped supports located at and extending from the first and second opposed ends of the base, respectively, each of the supports having a medial portion and first and second opposed legs, with each leg having a distal end and upper and lower tabs located along a portion of the leg;

wherein in use the lower tabs of the first support extend into the cutout of the first block and the upper tabs extend into the cutout of a third block overlying the first and second blocks;

wherein in use the lower tabs of the second support extend into the cutout of the second block and the upper tabs extend into the cutout of the third block;

wherein the distal ends of the legs create and maintain a mortar joint between the first and second layers when the block is supported on the spacer against the tops of the first and second blocks.

2. The spacer as described in claim 1 wherein when the spacer is used the distal ends of the legs are located within planes defined by the outer faces of the blocks such that the spacer is not visible when the mortar joints are filled.

3. The spacer as described in claim 1 further including one or more stiffening ribs.

4. The spacer as described in claim 1 further including a second spacing tab attached to the medial portion of the base along the other opposed edge thereof and extended at a downward angle from the base into the space between the first and second blocks to create and maintain the mortar joint between the first and second blocks.

5. A spacer in the construction of a wall, comprising:

a base including a medial portion, first and second opposed ends and a pair of opposed edges;

first and second spacing tabs attached to the medial portion of the base along the respective opposed edges thereof and extended at an angle from the base; and first and second supports located at and extending from the first and second opposed ends of the base, respectively, each of the supports having a medial portion and first and second opposed legs with each leg having a distal end, the medial portion extending at a predetermined angle with respect to the base and the first and second opposed legs extending at predetermined angles with respect to the medial portion, wherein each of the legs include a tab located along a medial portion of the leg.

* * * * *